United States Patent [19]

Kyatt

[11] Patent Number: 4,505,284

[45] Date of Patent: Mar. 19, 1985

[54] APPARATUS FOR SOLVENT CLEANING MACHINERY PARTS AND THE LIKE AND FOR CLEANING USED SOLVENT

[75] Inventor: Victor F. Kyatt, Birmingham, Ala.

[73] Assignee: Hurri-Kleen Corporation, Birmingham, Ala.

[21] Appl. No.: 472,599

[22] Filed: Mar. 7, 1983

[51] Int. Cl.[3] ..... B80B 3/02

[52] U.S. Cl. ..... 134/104; 134/109; 134/111

[58] Field of Search ..... 134/104, 110, 111, 182, 134/109; 210/513, 519

[56] References Cited

U.S. PATENT DOCUMENTS

| | | | |
|---|---|---|---|
| 2,653,116 | 9/1953 | Whitcomb et al. | 134/111 |
| 2,675,012 | 4/1954 | Scales | 134/111 X |
| 3,390,402 | 6/1968 | Goerg | 134/109 X |
| 3,707,404 | 12/1972 | Carlson et al. | 134/109 X |
| 3,890,988 | 6/1925 | Lee | 134/111 |
| 3,893,659 | 6/1975 | Krish | 134/111 X |
| 3,921,653 | 11/1975 | Ducharme | 134/111 X |
| 4,105,342 | 8/1978 | Plourde | 134/111 X |
| 4,122,861 | 10/1978 | Lee | 134/109 |
| 4,226,548 | 10/1980 | Reith | 134/111 X |

*Primary Examiner*—Stephen Marcus

*Attorney, Agent, or Firm*—Woodford R. Thompson, Jr.

[57] ABSTRACT

A method and apparatus for solvent cleaning machinery parts and for cleaning the used solvent includes a washbasin for receiving the machinery parts and a container beneath the washbasin for receiving the used cleaning solvent. An elongated drain pipe communicates at its upper end with a drain in the washbasin while the lower end of the drain pipe terminates within the lower portion of the container and in spaced relation to the bottom of the container. A transversely extending deflector member is mounted directly beneath and in spaced relation to the lower end of the drain pipe. As downwardly flowing used cleaning solvent from the drain pipe strikes the deflector member, it is deflected laterally and outwardly relative to the lower discharge end of the drain pipe to disperse the used solvent and to reduce turbulence in the lower portion of the container.

5 Claims, 3 Drawing Figures

APPARATUS FOR SOLVENT CLEANING MACHINERY PARTS AND THE LIKE AND FOR CLEANING USED SOLVENT

BACKGROUND OF THE INVENTION

This invention relates to a method and apparatus for solvent cleaning machinery parts and the like and more particularly to a method and apparatus having improved means for dispersing the used cleaning solvent as it is discharged into a container therefor so that a minimum of agitation is imparted to the sludge accumulated on the bottom of the container, thus greatly reducing turbulence.

Heretofore in the art to which my invention relates, various methods and systems have been employed to wash small machinery parts and the like. Such devices include parts washers as disclosed in U.S. Pat. No. 3,707,404 which utilizes two immiscible fluids of different densities to form a filter for removing foreign materials from the used cleaning solvent. With this parts washer, used cleaning solvent is drained from the washbasin for the machinery parts and is discharged downwardly onto the bottom of a container for the used solvent. This discharge of used solvent agitates the sludge accumulated on the bottom of the container and causes particles of sludge to rise with the lighter immiscible fluid into an upper zone of the fluid within the container. The turbulence thus created by the discharge of used cleaning solvent causes ineffective and inefficient cleaning of the used solvent.

Other parts washers with which I am familiar employ mechanical filters to remove foreign particles from the used cleaning solvent. Such mechanical filters are expensive and require considerable time and effort to maintain them in proper operating condition.

SUMMARY OF THE INVENTION

In accordance with my present invention, I overcome the above and other difficulties by providing an improved method and apparatus for solvent cleaning machinery parts and the like which efficiently cleans the used solvent employed to wash the parts without the use of layers of immiscible fluids of different densities to remove foreign matter from the used solvent.

The principal object of my invention is to provide a method and apparatus for solvent cleaning machinery parts and the like which includes improved means for dispersing the used solvent discharged into the lower portion of a container therefor in a direction which significantly reduces turbulence in the container thereby permitting heavy foreign matter in the used cleaning solvent to settle to the bottom of the container while lighter materials move toward an upper zone of the fluid in the container and are thus cleaned.

Another object of my invention is to provide a method and apparatus for solvent cleaning machinery parts and the like which extends the useful life of the solvent employed to wash the machinery parts and eliminates the necessity of disassembling parts of the cleaning apparatus to clean and/or replace mechanical filters.

My improved apparatus for washing machinery parts comprises a washbasin for receiving the machinery parts to be cleaned. A fluid-tight container is provided beneath the washbasin to receive the used cleaning solvent. An elongated drain pipe communicates at its upper end with a drain in the washbasin and extends downwardly into the lower portion of the container with the lower end of the drain pipe terminating below the surface of the used solvent in the container and in spaced relation to the bottom of the container. A transversely extending deflector member is mounted directly beneath and in spaced relation to the lowermost end of the drain pipe in position to direct the downwardly flowing used solvent laterally and outwardly relative to the lowermost end of the drain pipe to disperse the used cleaning solvent and reduce turbulence in the container. A pump transfers the used cleaning solvent from a location beneath the surface of the used cleaning solvent in the container back to the washbasin.

DESCRIPTION OF THE DRAWING

Apparatus embodying features of my invention and which may be employed to carry out my improved method for cleaning solvent is illustrated in the accompanying drawing, forming a part of this application, in which:

FIG. 1 is a vertical sectional view showing my improved apparatus for solvent cleaning machinery parts and the like;

DETAILED DESCRIPTION

Figure 1:
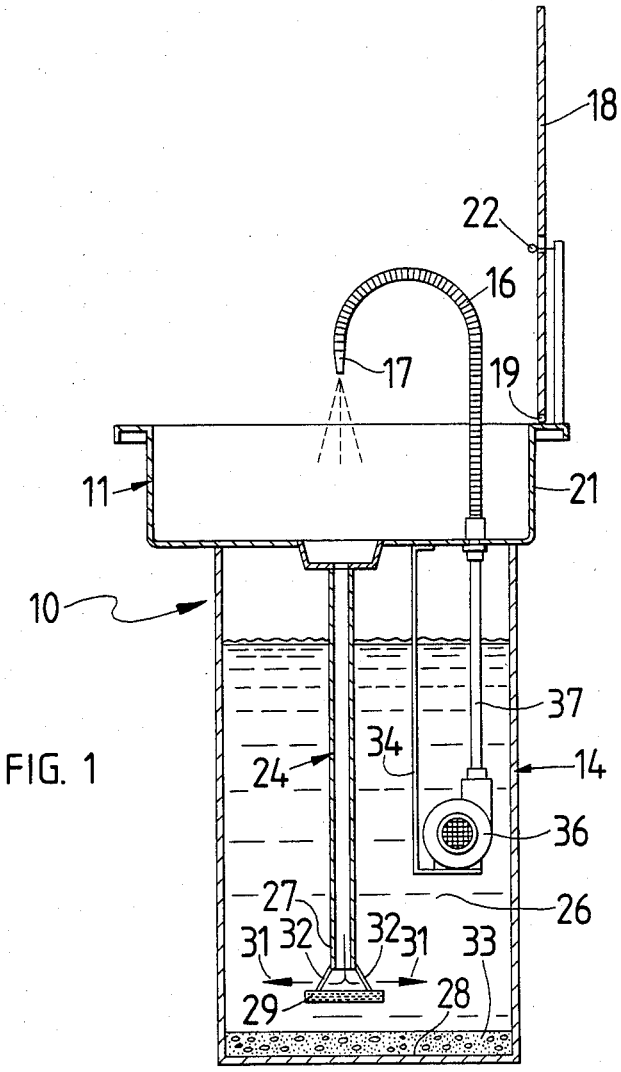
Figure 2:
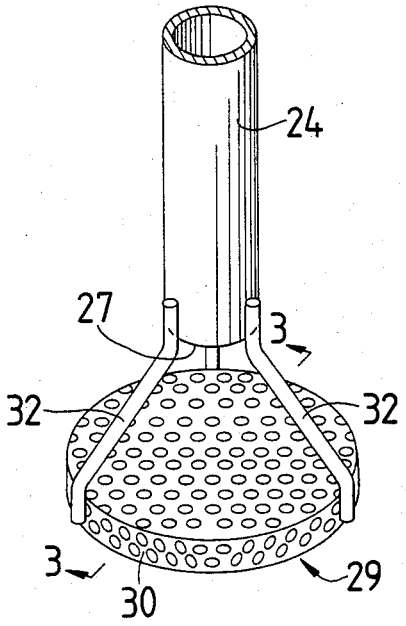
FIG. 2 is an enlarged, fragmental perspective view showing the deflector member carried by the lowermost end of the drain pipe; and, FIG. 3 is a fragmental, sectional view taken generally along the line 3—3 of FIG. 2.
Figure 3:
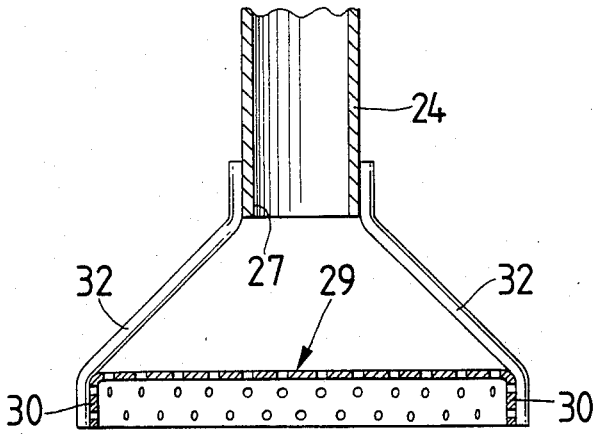

Referring now to the drawing for a better understanding of my invention, my improved apparatus for solvent cleaning machinery parts and the like is indicated generally at 10 and includes a washbasin 11 for receiving the machinery parts to be cleaned. As shown in FIG. 1, the washbasin 11 is provided with a drain 12 in its bottom 13. Preferably, the washbasin is supported by an upstanding fluid-tight container 14 for receiving used solvent. Clean solvent is introduced into the washbasin 11 by a flexible conduit 16 having a spray nozzle 17 at its discharge end. The conduit 16 is shown as extending through and attached to the bottom 13 of the washbasin 11 so that cleaned solvent may be delivered from the container 14 to the washbasin 11 to wash the machinery parts to be cleaned in the usual manner.

A cover 18 is shown pivotally connected at 19 to the upper edge of the rear side wall 21 of the washbasin 11. The cover 18 may be operatively connected to a conventional fusable link connector 22 which melts and permits the cover to close automatically in the event a fire should occur in the washbasin 11.

As shown in FIG. 1, the upper end 23 of an elongated drain pipe 24 communicates with the drain 12 and extends downwardly into the container 14 for delivering used cleaning solvent 26 from the wash basin 11 to the lower portion of the container 14, as shown. The lowermost end 27 of the drain pipe 24 terminates well below the surface of the used cleaning solvent 26 in the container 14 and in spaced relation to the bottom 28 of the container, as shown.

A transversely extending deflector member 29 is mounted directly beneath and in spaced relation to the lowermost end 27 of the drain pipe 24. Preferably, the deflector member 29 is a perforated plate-like member having depending side walls 30. The deflector member 29 is located beneath the lowermost end 27 of the drain pipe 24 in position to disperse used solvent laterally and outwardly relative to the lowermost end 27 of the drain pipe, as indicated by arrows 31. As shown in FIG. 1, the lowermost end 27 of the drain pipe 24 is connected to a plurality of retainer elements 32 which in turn are connected to and support the deflector member 29 at a predetermined distance above the bottom 28 of the container 14. In actual practice I have found that the deflector member 29 deflects the used cleaning solvent satisfactorily in every respect when it is supported above the bottom 28 a vertical distance ranging from approximately two inches to six inches. Preferably, the deflector member 29 is supported above the bottom 28 a vertical distance of approximately four inches to obtain optimum dispersement of the used cleaning solvent within the lower portion of the container 14 and at the same time obtain minimum turbulence in the container. This permits heavy foreign materials in the used cleaning solvent to quickly settle to the bottom 28 as sludge indicated at 33, while lighter materials rise toward the upper zone of the fluid in the container 14 and are thus cleaned. A conventional valve, not shown, may be provided adjacent the bottom 28 of the container 14 to remove the sludge 33 and the used cleaning solvent 26 as required.

As shown in FIG. 1, a mounting bracket 34 supports a suitable pump 36 within the container 14 below the surface of the cleaning solvent 26. The pump 36 transfers the cleaned solvent from a location beneath the surface of the solvent through a conduit 37 to the flexible conduit 16. While I have shown the pump 36 as being mounted within the fluid-tight container 14, it will be apparent that it may be placed at other locations relative to the container 14 to transfer used cleaning solvent from a point beneath the surface of the cleaning solvent in the container 14 to the flexible conduit 16.

From the foregoing description, the operation of my improved apparatus for solvent cleaning machinery parts and for cleaning the used solvent employed to wash the parts will be readily understood. A predetermined volume of cleaning solvent 26 is placed in the container 14 and the pump 36 transfers the solvent through the conduit 37 to the flexible conduit 16 where it is discharged into the washbasin 11 to wash the machinery parts. Used cleaning solvent then flows downwardly through the drain 12 and through the drain pipe 24. Upon being discharged from the lower end of drain pipe 24, the used solvent strikes the upper surface of the deflector member 29. As the downwardly flowing used cleaning solvent strikes the deflector member 29, it is dispersed laterally and outwardly relative to the lowermost end 27 of the drain pipe 24. This dispersement of the used cleaning solvent causes the heavier foreign particles in the solvent to quickly settle toward the bottom 28 since a minimum of turbulence occurs in the lower portion of the container 14. As the foreign particles settle to the bottom 28, lighter foreign materials move toward the upper zone of fluid in the container 14 whereby the solvent is cleaned and then transferred by the pump 36 to the flexible conduit 16 which discharges the cleaned solvent into the basin 11.

From the foregoing, it will be seen that I have devised an improved method and apparatus for solvent washing machinery parts and the like and for cleaning the solvent employed to wash the parts. By providing a deflector member mounted directly beneath and in spaced relation to the lower end of the drain pipe the used cleaning solvent is dispersed laterally and outwardly in a direction to greatly reduce turbulence adjacent and above the bottom of the container for the used solvent. Also, my improved apparatus for solvent cleaning machinery parts and efficiently cleaning the used solvent eliminates the necessity of providing mechanical filters and the use of layers of immiscible fluids. Furthermore, I provide cleaning apparatus which economically and efficiently cleans and extends the useful life of the cleaning solvent employed to wash machinery parts.

While I have shown my invention in but one form, it will be obvious to those skilled in the art that it is not so limited, but is susceptible of various changes and modifications without departing from the spirit thereof.

What I claim is:

1. Apparatus for solvent cleaning machinery parts and the like comprising:

(a) a washbasin for said machinery parts having a drain in the bottom thereof for discharging used cleaning solvent, (b) means for dispensing a cleaning solvent into said washbasin, (c) a fluid-tight container beneath said washbasin for receiving said used cleaning solvent, (d) an elongated drain pipe communicating at one end with said drain and extending downwardly into the lower portion of said container with the lowermost end of said drain pipe terminating well below the surface of said used cleaning solvent and in spaced relation to the bottom of said container, (e) a transversely extending deflector member mounted beneath and in spaced relation to said lowermost end of said drain pipe and in spaced relation to the bottom of said container in position to deflect the downwardly flowing used cleaning solvent from said drain pipe horizontally, thus laterally and outwardly relative to said lowermost end to disperse said used cleaning solvent and reduce turbulence, and (f) means transferring said used cleaning solvent from a location beneath the surface of said used solvent to said means for dispensing said cleaning solvent into said washbasin.

2. Apparatus for solvent cleaning machinery parts and the like as defined in claim 1 in which said deflector member is a perforated plate-like member extending in a plane generally perpendicular to the direction of flow of said used cleaning solvent from said drain pipe.

3. Apparatus for solvent cleaning machinery parts and the like as defined in claim 2 in which said plate-like member is supported by a plurality of retainer elements extending between said plate-like member and said lowermost end of said drain pipe.

4. Apparatus for solvent cleaning machinery parts and the like as defined in claim 2 in which said plate-like member is retained at a distance ranging from approximately two inches to six inches above the bottom of said container.

5. Apparatus for solvent cleaning machinery parts and the like as defined in claim 4 in which said plate-like member is retained at a distance of approximately four inches above the bottom of said container.

* * * * *